United States Patent [19]

Manschwetus

[11] Patent Number: 4,898,334

[45] Date of Patent: Feb. 6, 1990

[54] ARRANGEMENT FOR SECURING A CAP TO THE END OF A SUPPORTING BODY OF A HAMMER MILL ROTOR

[75] Inventor: Helmut Manschwetus, Fuldabrück, Fed. Rep. of Germany

[73] Assignee: Thyssen Industrie AG Henschel, Essen, Fed. Rep. of Germany

[21] Appl. No.: 234,208

[22] Filed: Aug. 19, 1988

[30] Foreign Application Priority Data

Aug. 21, 1987 [DE] Fed. Rep. of Germany ..... 3727870

[51] Int. Cl.[4] ..... B02C 13/04

[52] U.S. Cl. ..... 241/194; 241/197; 241/300

[58] Field of Search ..... 241/189 A, 189 R, 191, 241/194, 197, 300

[56] References Cited

U.S. PATENT DOCUMENTS

| | | | |
|---|---|---|---|
| 3,727,848 | 4/1973 | Francis | 241/194 |
| 4,313,575 | 2/1982 | Stepanek | 241/194 |
| 4,519,551 | 5/1985 | Ceurvorst | 241/194 |
| 4,650,129 | 3/1987 | Newell et al. | 241/194 X |

*Primary Examiner*—Joseph Gorski

*Attorney, Agent, or Firm*—Becker & Becker, Inc.

[57] ABSTRACT

An arrangement for securing a cap to the end of a supporting body of a hammer mill rotor. The forward end of the supporting body end is provided with a front projection that is an integral part of the supporting body end and extends parallel to the axis of rotation of the rotor. The rearward end of the supporting body end is provided with a recessed portion for receiving a filler member that forms a rear projection. The front and rear walls of the cap are provided with respective flanges that are directed toward one another, extend parallel to the axis of rotation of the rotor, and extend in a hook-like manner about the front and rear projections. The cap covers all sides of the supporting body end but leaves free spaces between a hammer shaft and the side walls of the cap. The side walls are provided at each end with an opening through one of which a filler member can be inserted into the recessed portion of the rearward end, whereby to secure the filler member in the recessed portion, and to thereby secure the cap to the supporting body end, a resilient element is introduced into the filler member and also extends into a recess provided in an inner surface of the rear wall of the cap.

2 Claims, 4 Drawing Sheets

ARRANGEMENT FOR SECURING A CAP TO THE END OF A SUPPORTING BODY OF A HAMMER MILL ROTOR

BACKGROUND OF THE INVENTION

The present invention relates to an arrangement for securing a cap to the end of a supporting body of a hammer mill rotor that has a plurality of supporting body ends disposed next to one another and staggered in the direction of rotation of the rotor, with hammer shafts being mounted in the supporting body ends and extending parallel to the axis of rotation of the rotor over the length of the rotor. A respective hammer or shaft-protecting member is mounted, in such a way that it can swing, between each two adjacent, spaced-apart supporting body ends that are disposed parallel to one another.

With hammer mill rotors, caps are used to reduce the wear that occurs during operation at the ends of the supporting bodies, and to avoid time consuming repairs, such as the welding or sputtering of wear-resistant material onto these supporting body ends.

U.S. Pat. No. 3,727,848 discloses a cap that covers a portion of the peripheral surface of the supporting body and the forward supporting body end face as viewed in the direction of rotation of the rotor. Securement of this known cap is effected by inserting beads or abutments that are disposed on both sides of the cap web into corresponding recesses of a socket in the supporting body. When the hammer shaft is inserted, the cap is kept from falling off.

The drawback of this heretofore known cap securement is that the cap can be removed, for example for replacement, only after the hammer shaft has been removed. Thus, it is a very complicated and time consuming process to remove a single cap.

It is therefore an object of the present invention to provide for securement of a cap in such a way that, while retaining the advantage of the positive transmission of the centrifugal forces that act upon the cap to the supporting body, the cap can be removed without having to remove the hammer shaft, and the cap has a longer service life.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The arrangement of the present invention is characterized primarily in that: each of the supporting body ends has, relative to the direction of rotation of the rotor, a forward end and a rearward end, with the forward end being provided with a first front projection that is an integral part of the supporting body end and extends parallel to the axis of rotation of the rotor, and with the rearward end being provided with a recessed portion that is adapted to receive a filler member that forms a second rear projection and also extends parallel to the axis of rotation of the rotor; and each of the caps, relative to the direction of rotation of the rotor in the installed state, has a front wall and a rear wall, with these walls being provided with respective flanges that are directed toward one another, extend parallel to the axis of rotation of the rotor, and extend in a hook-like manner about the front and rear projections; the cap also has two side walls, and in the installed state the cap covers all sides of the supporting body end but leaves free spaces between the side walls and a hammer shaft; each side wall has two ends, each of which is provided with an opening through one of which a filler member can be inserted into the recessed portion in the rearward end, whereby to secure the filler member in the recessed portion, and to thereby secure the cap to the supporting body end, a resilient element is introduced into the filler member and also extends into a recess provided in an inner surface of the rear wall of the cap.

The advantages achieved with the present invention are that with each cap, the filler member, as a projection for the positive securement of the cap, can be inserted independently of adjacent parts of the rotor, and can also be again removed for changing the cap, and that the shape required to accomplish this by the supporting body end, with its front projection (relative to the direction of rotation of the rotor) and the rearward recessed portion, can be produced in a simple manner, for example by flame cutting. In addition, the arrangement of the two projections makes it possible, after an end of the cap that faces in the direction of rotation of the rotor has become worn, to turn the correspondingly shaped cap and thus double the service life of the cap. It is also possible to utilize the inventive securing arrangement of the cap with appropriately designed end plates of rotors, as a result of which a standard cap shape is provided for the entire rotor, with the accompanying advantage of simplifying stocking requirements.

Further specific features of the present invention will be described in detail subsequently.

DESCRIPTION OF PREFERRED EMBODIMENTS

Figure 1:
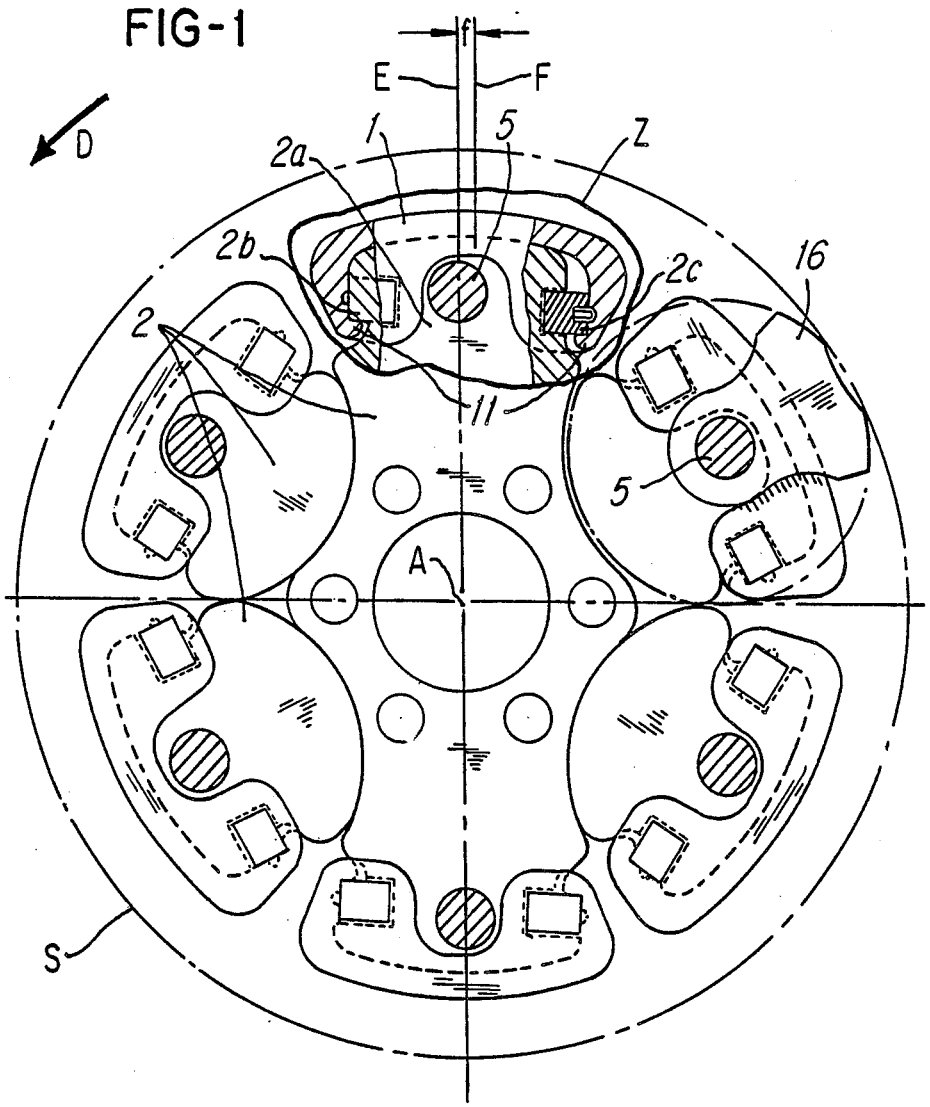
FIG. 1 is a cross-sectional end view through one exemplary embodiment of an inventive hammer mill rotor with side views of plate-like supporting bodies which are staggered in the circumferential direction, and positively connected caps.

Referring now to the drawings in detail, in the cross-sectional end view of FIG. 1 through a hammer mill rotor, the plate-like supporting bodies 2 are staggered relative to one another in the circumferential direction. The ends 2*a* of the supporting bodies 2 are provided with positively secured caps 1. The hammer shafts 5 extend over the length of the rotor and are mounted in the ends 2*a* of the supporting bodies 2; hammers 16 that can swing are pivotably mounted on the shafts 5. Also indicated are the axis of rotation A of the rotor, the direction of rotation D of the rotor, and the path S of the hammers 16. The plane of symmetry F of the cap 1 is disposed perpendicular to the direction of rotation D of the rotor and is offset by a distance "f" from the plane E that extends through the axis of rotation A of the rotor and through the hammer shaft 5.

Figure 2:
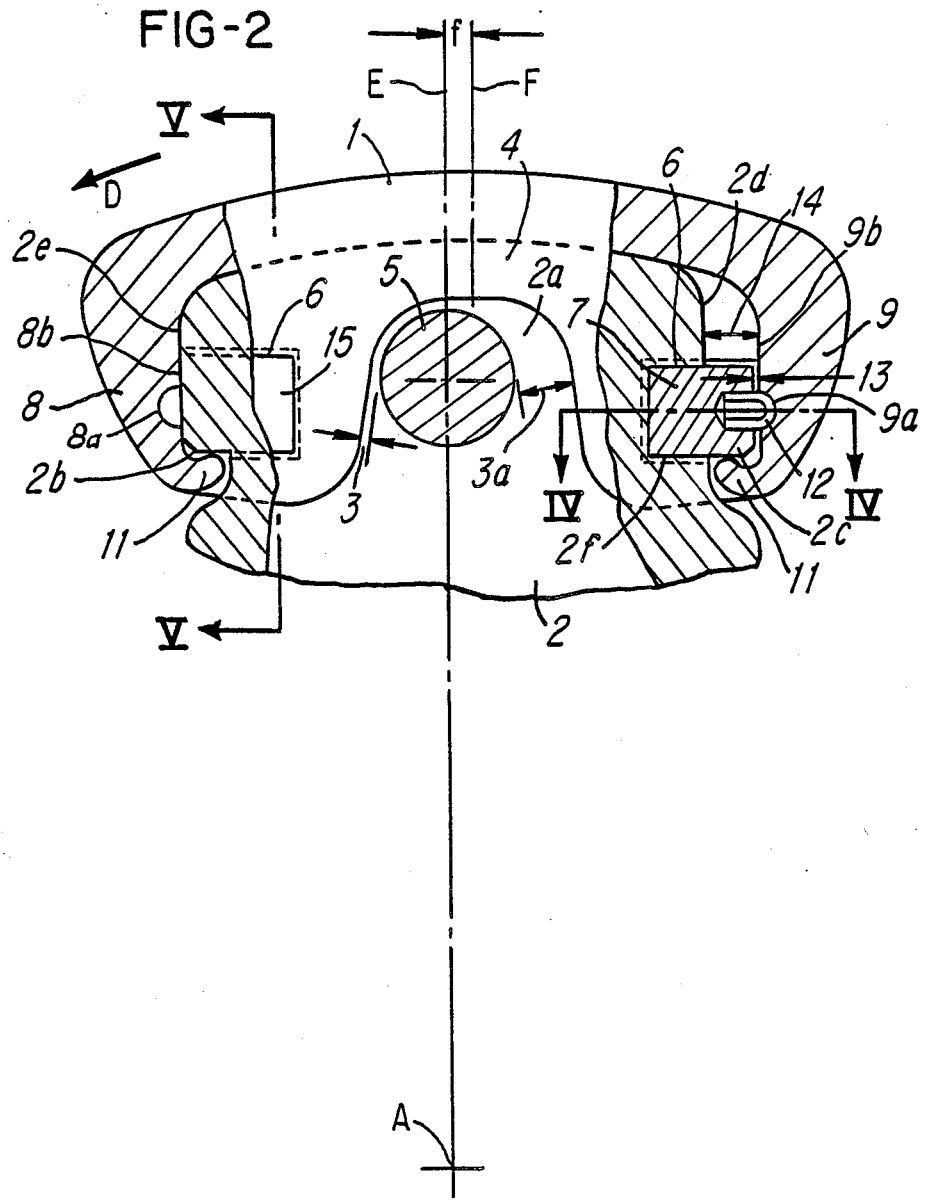
FIG. 2 is an enlarged view of the portion indicated by Z in FIG. 1.
Figure 3:
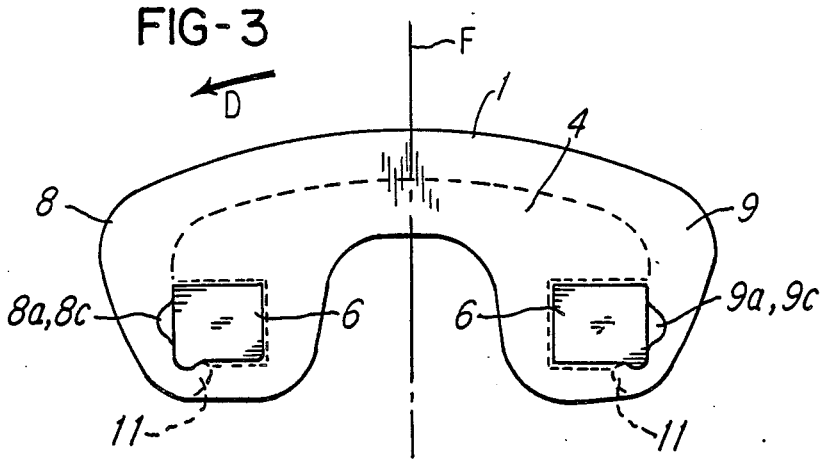
FIG. 3 is a side view of a cap.

The enlarged detailed view in FIG. 2 of the portion Z of FIG. 1 shows how a cap 1 is secured or mounted. The cap 1 covers the end 2a of the supporting body 2 on all sides. The central portion of the side walls 4 of the cap 1 is narrower than are the ends of the cap, and is provided with free spaces 3 and 3a for the hammer shaft 5. Provided at both ends of the side walls 4 are nearly rectangular openings 6 (see also FIG. 3), the inside width of which is greater than the cross section of the filler member 7 that is introduced into a recess 2f at the rearward end 2d of the supporting body 2 as viewed in the direction of rotation D of the rotor, thereby forming a projection 2c. A resilient element 12 that is introduced into the filler member 7 secures the position of the latter; the resilient element 12 furthermore extends into a recess 9a provided on the inner surface of the rear wall 9 of the cap 1. The cap flanges 11, which face or are directed toward one another and are respectively disposed on the bottom edge of the front wall 8 or rear wall 9 of the cap, extend in a hook-like manner about the rear (relative to the direction of rotation D of the rotor) projection 2c formed by the filler member 7, and the front projection 2b, which is an integral part of the supporting body end 2a and is disposed parallel to the axis of rotation A of the rotor. Relative to the hammer shaft 5, in the direction of rotation D of the rotor and toward the supporting body end, the side walls 4 have a narrow free space 3, and in a direction opposite to the direction of rotation D of the rotor, the side walls 4 have a considerably wider free space 3a. The plane of symmetry F of the cap 1 is disposed a distance "f" behind (relative to the direction of rotation D of the rotor) the plane E that extends through the hammer shaft 5 and the axis of rotation A of the rotor. In the assembled state, and during operation of the rotor, the inner surface 8b of the front wall 8 of the cap 1, which inner surface 8b extends parallel to the plane E, rests against the front (relative to the direction of rotation D of the rotor) face 2e of the supporting body end 2a. The inner surface 9b of the rear wall 9 of the cap 1, which inner surface 9b is also disposed parallel to the plane E, exhibits a narrow mounting gap 13 relative to the rearwardly directed planar face of the filler member 7. To remove the cap the filler member 7 is pressed out to the side, accompanied by an overcoming of the securing action of the resilient element 12. The cap 1 is subsequently pivoted to the front about the edge of the projection 2b, and is lifted off. Installation of the cap 1 is effected in the reverse order.

Figure 4:
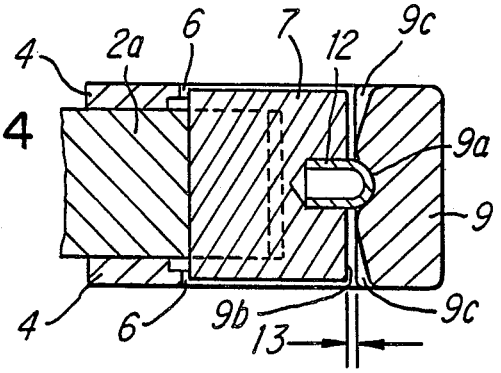
FIG. 4 is an enlarged cross-sectional view taken along the line IV—IV in FIG. 2.

FIG. 4 is an enlarged view of the installed state of the filler member 7, and is taken along the line IV—IV in FIG. 2. To protect the protruding end of the resilient element 12, inclined or bevelled approach portions 9c are provided on the inner surface 9b of the rear wall 9 of the cap 1 on both sides of the recess 9a. The free space 14 that in the installed state of the filler member 7 remains between the rearward end 2d and the inner surface 9b of the rear cap wall 9 is great enough that the flange 11 of the rear wall 9 has enough room or play during mounting or removal of the cap 1. The cap 1 is symmetrically shaped relative to the plane F, so that after the front (relative to the direction of rotation D of the rotor) end has worn away, the cap can be turned one time, resulting in a doubling of its useful life. In this connection, a recess 8a (similar to the recess 9a) is provided in the inner surface 8b of the front cap wall 8 for receiving the resilient element 12 in order to secure the filler member 7 in the recess 2f, and thus to secure the cap 1 to the supporting body 2.

Figure 5:
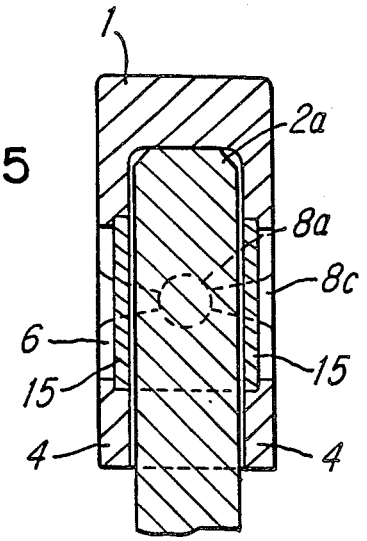
FIG. 5 is an enlarged cross-sectional view taken along the line V—V in FIG. 2.

As shown in the enlarged view of FIG. 5, which is taken along the line V—V of FIG. 2, the openings 6 in the side walls 4 on both longitudinal sides of the supporting body end 2a are provided with cover or closure members 15 that are tightly disposed in recesses of the side walls in order to prevent damage to the longitudinal sides of the supporting body end 2a.

Figure 6:
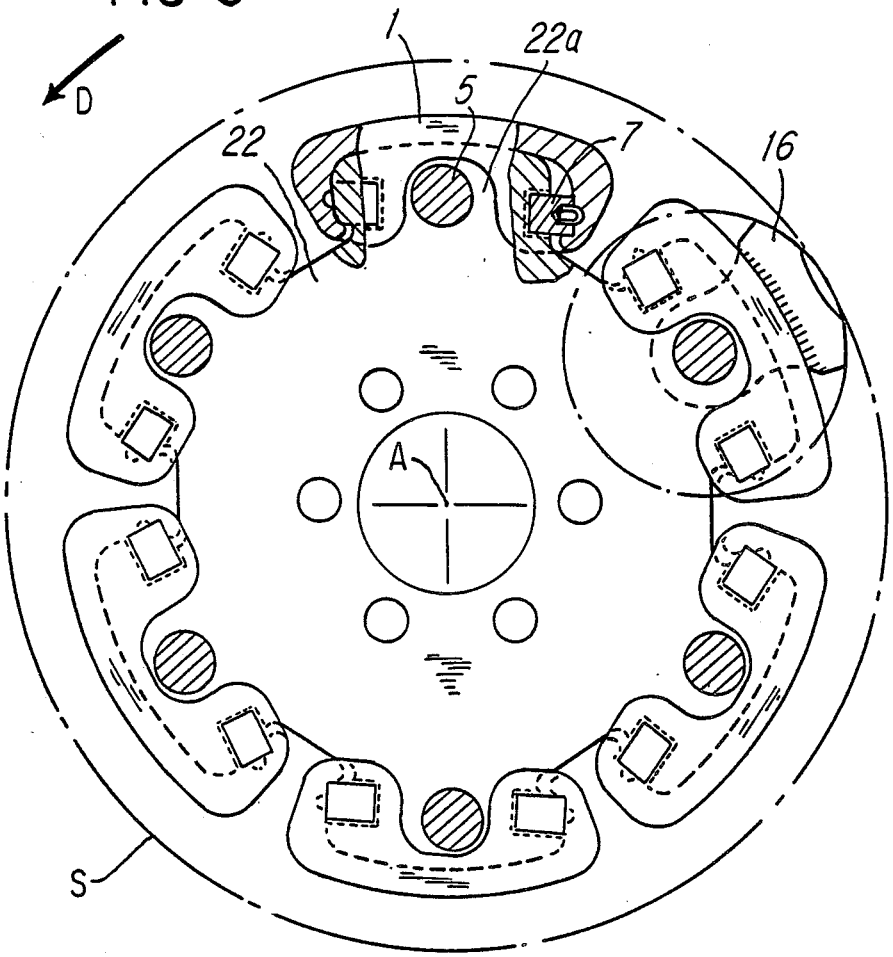
FIG. 6 is an end view of an end plate of the rotor with caps.

FIG. 6 shows an end view of an end plate of a rotor with caps. In the illustrated embodiment, the outer periphery of the rotor plate 22 is provided with six arm ends 22a, the contour of which corresponds to the supporting body ends 2a, so that the caps 1 can be secured thereto in the same manner as described in connection with the supporting body ends 2a. Thus, not only the supporting bodies 2 but also the two end plates of a rotor can be provided with a single type of cap 1.

The present invention is, of course, in no way restricted to the specific disclosure of the specification and drawings, but also encompasses any modifications within the scope of the appended claims.

What I claim is:

1. In a hammer mill, an arrangement for securing a cap to the end of a supporting body of a hammer rotor that has an axis of rotation and a plurality of supporting body ends disposed next to one another and staggered in the direction of rotation of said rotor, with hammer shafts being mounted in said supporting body ends and extending parallel to said axis of rotation of said rotor over the length of said rotor, and with respective hammers and shaft-protecting members being selectively mounted, in such a way that they can swing, between each two adjacent, spaced apart supporting body ends that are disposed parallel to one another, the improvement wherein:

each of said supporting body ends has, relative to said direction of rotation of said rotor, a forward end and a rearward end, with said forward end being provided with a first front projection that is an integral part of said supporting body end and extends parallel to said axis of rotation of said rotor, and with said rearward end being provided with a recessed portion; a filler member is received in said recessed portion of said rearward end, whereby said filler member forms a second rear projection and also extends parallel to said axis of rotation of said rotor; and said cap, relative to said direction of rotation of said rotor, has a front wall and a rear wall, with said front and rear walls being provided with respective flanges that are directed toward one another, extend parallel to said axis of rotation of said rotor, and extend in a hook-like manner about said first front projection and said second rear projection; said cap also has two side walls and covers all sides of said supporting body end while leaving free spaces between said side walls and a hammer shaft; each of said side walls has two ends, each of which is provided with an opening through one of which said filler member is inserted into said recessed portion of said rearward end, and whereby to secure said filler member in said recessed portion, and to thereby secure said cap to said supporting body end, a resilient element is introduced into said filler member and also extends into a recessed provided in an inner surface of said rear wall of said cap.

2. An arrangement according to claim 1, in which said front wall of said cap has an inner surface that is also provided with a recess in conformity to said recess in said inner surface of said rear wall of said cap, so that if the position of said cap on said supporting body end is reversed relative to said direction of rotation of said rotor, said former front wall of said cap now becomes the rear wall thereof and its recess can received said resilient element.

* * * * *